US011840393B2

(12) United States Patent
Maldonado et al.

(10) Patent No.: US 11,840,393 B2
(45) Date of Patent: Dec. 12, 2023

(54) COOLER LATCH

(71) Applicant: Igloo Products Corp., Katy, TX (US)

(72) Inventors: John Maldonado, Katy, TX (US); James Ira McKenrick, Katy, TX (US); Roque Barros, Katy, TX (US)

(73) Assignee: Igloo Products Corp., Katy, TX (US)

( * ) Notice: Subject to any disclaimer, the term of this patent is extended or adjusted under 35 U.S.C. 154(b) by 0 days.

(21) Appl. No.: 17/113,253

(22) Filed: Dec. 7, 2020

(65) Prior Publication Data

US 2021/0229893 A1 Jul. 29, 2021

Related U.S. Application Data

(60) Provisional application No. 62/967,199, filed on Jan. 29, 2020.

(51) Int. Cl.
*B65D 81/38* (2006.01)
*B65D 43/16* (2006.01)
(Continued)

(52) U.S. Cl.
CPC ..... *B65D 81/3813* (2013.01); *B65D 43/163* (2013.01); *B65D 43/22* (2013.01);
(Continued)

(58) Field of Classification Search
CPC .. B65D 81/3813; B65D 43/163; B65D 43/22; B65D 45/22; B65D 2251/1058;
(Continued)

(56) References Cited

U.S. PATENT DOCUMENTS 4,089,467 A * 5/1978 Makowicki ..... B65D 43/168 16/382
4,213,310 A 7/1980 Buss
(Continued)

FOREIGN PATENT DOCUMENTS

AU 2707277 1/1979
AU 83403 9/1981
(Continued)

OTHER PUBLICATIONS

Young, Lee, International Search Report and Written Opinion issued in PCT/US2020/063545, dated Mar. 10, 2021, 9 pages.
(Continued)

*Primary Examiner* — Valentin Neacsu
*Assistant Examiner* — Eric C Baldrighi
(74) *Attorney, Agent, or Firm* — Dinsmore & Shohl LLP

(57) ABSTRACT

The insulated cooler includes a body, a lid, and at least one latch assembly. The body includes an outer shell, an inner liner disposed therein creating a gap therebetween, and an insulating layer disposed within the gap. The body defines a cavity therein with an opening formed at its upper end. The lid is removably coupled to the body and covers the body's opening. The latch assembly includes an upper component having at least one aperture formed therein, a lower component having at least one opening formed therein, and an intermediate component having a first portion coupled to the upper component and a second portion coupled to the lower component. The intermediate component is fabricated using a thermoplastic rubber. The upper component is coupled to the lid using at least one aperture. The lower component is coupled to a top portion of the outer shell using at least one opening.

20 Claims, 2 Drawing Sheets

(51) Int. Cl.
*B65D 43/22* (2006.01)
*B65D 45/22* (2006.01)

(52) U.S. Cl.
CPC ..... *B65D 45/22* (2013.01); *B65D 2251/1058* (2013.01); *B65D 2543/00101* (2013.01); *B65D 2543/00296* (2013.01)

(58) Field of Classification Search
CPC ..... B65D 2543/00101; B65D 2543/00296; B65D 81/3823; B65D 2251/1016; A45C 11/20; A45C 13/1084
USPC ..... 220/324
See application file for complete search history.

(56) References Cited

U.S. PATENT DOCUMENTS

D257,934 S 1/1981 Buss
D267,444 S 1/1983 Ruxton
D268,979 S 1/1983 Ruxton
D269,398 S 6/1983 Ruxton
D289,597 S 5/1987 Averitt
D292,056 S 9/1987 Decker
4,696,412 A 9/1987 McGowan
D307,998 S 5/1990 Costello et al.
4,938,513 A * 7/1990 Gunderson ..... E05C 19/066 292/87
D323,950 S 2/1992 Pleet
5,319,937 A 6/1994 Fritsch
D349,007 S 7/1994 Costello
D352,420 S 11/1994 Costello
D400,053 S 10/1998 Coffee
5,860,281 A 1/1999 Coffee
D486,357 S 2/2004 Leba
D497,517 S 10/2004 Reuter
D500,057 S 12/2004 Reuter
7,051,550 B2 5/2006 Roth
D527,226 S 8/2006 Maldonado
D528,368 S 9/2006 Maldonado
D529,344 S 10/2006 Maldonado
7,140,507 B2 11/2006 Maldonado
D534,771 S 1/2007 Zorn
7,344,028 B2 3/2008 Hanson
9,366,467 B2 6/2016 Kiedaisch
D792,486 S 7/2017 Li
D802,028 S 11/2017 Li
D802,029 S 11/2017 Li
D802,630 S 11/2017 Li
9,827,730 B2 * 11/2017 Smyers ..... B29C 45/1615
D820,049 S 6/2018 Ahlstrom
D836,993 S 1/2019 Meda
D836,994 S 1/2019 Meda
D844,386 S 4/2019 Ahlstrom
D887,788 S 6/2020 Meda
D888,503 S 6/2020 Meda
D894,043 S 8/2020 Meda
D901,986 S 11/2020 Meda
D904,830 S 12/2020 Meda
D907,074 S 1/2021 Yang
D920,743 S 6/2021 Meda
D921,439 S 6/2021 Meda
11,027,885 B2 6/2021 Duong
D927,938 S 8/2021 Meda
D929,471 S 8/2021 Meda
D933,449 S 10/2021 Ahlström
D935,280 S 11/2021 Thelin
D953,814 S 6/2022 Thelin
D954,764 S 6/2022 Meda
11,359,848 B2 6/2022 Guan
11,535,425 B2 12/2022 Ahlström
2004/0089582 A1 5/2004 Hendrix, Jr.
2004/0178208 A1 9/2004 Minh
2005/0127081 A1 6/2005 Minh
2005/0263432 A1 12/2005 Hanson
2005/0263527 A1 12/2005 Maldonado
2005/0263528 A1 12/2005 Maldonado
2005/0279123 A1 12/2005 Maldonado
2005/0279124 A1 12/2005 Maldonado
2007/0023439 A1 2/2007 Vaughn
2007/0045330 A1* 3/2007 McFadyen ..... B65D 43/0218 220/793
2008/0001373 A1 1/2008 Vaughn
2008/0006629 A1 1/2008 Roth
2008/0025544 A1 1/2008 Maldonado
2008/0264946 A1* 10/2008 Moschella ..... B25H 3/02 292/277
2011/0139777 A1* 6/2011 Sosnovsky ..... B65D 45/22 220/23.83
2011/0182532 A1 7/2011 Baltus
2011/0197625 A1 8/2011 Urban
2012/0132657 A1 5/2012 Seiders
2012/0193353 A1* 8/2012 Cronin ..... A45C 5/03 29/434
2013/0340467 A1 12/2013 Kiedaisch
2015/0060470 A1* 3/2015 Seiders ..... B65D 81/3816 220/592.2
2017/0023290 A1 1/2017 DeMuth
2017/0313492 A1 11/2017 Seiders et al.
2018/0141718 A1* 5/2018 Ahlström ..... B65D 25/20
2018/0186550 A1* 7/2018 Morine ..... B65D 43/16
2018/0220761 A1* 8/2018 Jameson ..... A45C 13/1092
2019/0152677 A1* 5/2019 Hoyt ..... B65D 81/3823
2019/0161240 A1 5/2019 Ahlstrom
2020/0062454 A1 2/2020 Duong
2020/0140165 A1 5/2020 Maldonado
2020/0216229 A1 7/2020 Weixian
2020/0217571 A1 7/2020 Weixian
2020/0217574 A1 7/2020 Thelin
2020/0217575 A1 7/2020 Thelin
2020/0217576 A1 7/2020 Weixian
2020/0217578 A1 7/2020 Wang
2020/0399028 A1* 12/2020 Bullock ..... B65D 51/1611
2021/0070523 A1 3/2021 Iyer
2021/0070528 A1 3/2021 Iyer
2021/0071930 A1 3/2021 Iyer
2021/0123656 A1 4/2021 Barros
2021/0127808 A1 5/2021 Thelin
2021/0214123 A1 7/2021 Iyer
2021/0229893 A1 7/2021 Maldonado
2021/0253305 A1 8/2021 Duong
2021/0285710 A1 9/2021 Barros
2022/0114847 A1 4/2022 Emde
2022/0114853 A1 4/2022 Emde
2022/0119152 A1 4/2022 Blankinship
2022/0228406 A1 7/2022 Barros
2022/0290907 A1 9/2022 Guan
2022/0338603 A1 10/2022 Gamboa
2022/0355984 A1 11/2022 Guan
2022/0388722 A1 12/2022 Ahlström
2022/0390163 A1 12/2022 Thelin

FOREIGN PATENT DOCUMENTS

AU 83402 4/1982
AU 93721 10/1986
AU 2004100207 A4 * 4/2004 ..... B44D 3/127
AU 2005262599 1/2006
AU 2011215734 8/2012
AU 201712770 5/2017
AU 201712777 5/2017
AU 201712780 5/2017
AU 201712782 5/2017
AU 201712791 5/2017
AU 201712799 5/2017
AU 201712802 5/2017
AU 201712803 5/2017
AU 201712785 7/2017
AU 201716789 11/2017
AU 201716791 11/2017
AU 201717667 1/2018
AU 201717669 1/2018
AU 201717670 1/2018
AU 201717674 1/2018

(56) References Cited

FOREIGN PATENT DOCUMENTS

| | | | | |
|---|---|---|---|---|
| AU | 201717676 | | 1/2018 | |
| AU | 201717662 | | 2/2018 | |
| AU | 201816061 | | 1/2019 | |
| AU | 201910011 | | 2/2019 | |
| AU | 201913598 | | 8/2019 | |
| AU | 201913601 | | 8/2019 | |
| AU | 201913603 | | 8/2019 | |
| AU | 201913604 | | 8/2019 | |
| AU | 201913607 | | 8/2019 | |
| AU | 201913624 | | 8/2019 | |
| AU | 201913626 | | 8/2019 | |
| AU | 201913627 | | 8/2019 | |
| AU | 201913631 | | 8/2019 | |
| AU | 201913633 | | 8/2019 | |
| AU | 202012545 | | 6/2020 | |
| AU | 202012548 | | 6/2020 | |
| AU | 2019284128 | | 7/2020 | |
| AU | 2019284129 | | 7/2020 | |
| AU | 2019284130 | | 7/2020 | |
| AU | 2019284131 | | 7/2020 | |
| AU | 2019284133 | | 7/2020 | |
| AU | 2019284134 | | 7/2020 | |
| AU | 2019302329 | | 1/2021 | |
| AU | 2019325454 | | 1/2021 | |
| AU | 2019376154 | | 3/2021 | |
| AU | 2019371335 | | 5/2021 | |
| CA | 48429 | | 7/1981 | |
| CA | 48762 | | 10/1981 | |
| CA | 53100 | | 7/1984 | |
| CA | 1281859 | | 3/1991 | |
| CA | 2229259 | | 8/1998 | |
| CA | 2460597 | | 9/2004 | |
| CA | 2570413 | | 1/2006 | |
| CA | 2789507 | | 8/2011 | |
| CA | 179459 | | 12/2018 | |
| CA | 179460 | | 12/2018 | |
| CA | 3105713 | | 1/2020 | |
| CA | 3106550 | | 2/2020 | |
| CA | 3117297 | | 5/2020 | |
| CA | 214387 | | 7/2022 | |
| CN | 101370699 | | 2/2009 | |
| CN | 101431913 | | 5/2009 | |
| CN | 106233083 | | 7/2019 | |
| CN | 110191654 | | 8/2019 | |
| CN | 305553099 | | 1/2020 | |
| CN | 305751278 | | 5/2020 | |
| CN | 306079204 | | 9/2020 | |
| CN | 112424547 | | 2/2021 | |
| CN | 112585416 | | 3/2021 | |
| CN | 112955703 | | 6/2021 | |
| CN | 112996411 | | 6/2021 | |
| CN | 115214988 | | 10/2022 | |
| DE | 20110247 | | 12/2002 | |
| DE | 202004010081 | | 9/2004 | |
| DE | 202007001638 | | 5/2007 | |
| DE | 202009015164 | | 3/2010 | |
| DE | 202013007655 | | 1/2015 | |
| DE | 102019200065 | | 1/2019 | |
| DE | 102019200067 | | 1/2019 | |
| DE | 102019200068 | | 1/2019 | |
| DE | 102019200070 | | 1/2019 | |
| DE | 112017005901 | | 8/2019 | |
| DE | 102019200063 | | 7/2020 | |
| DE | 102019200064 | | 7/2020 | |
| EP | 1186251 | A1 * | 3/2002 | ..... A44B 11/006 |
| EP | 1765109 | | 3/2007 | |
| EP | 2534026 | | 12/2012 | |
| EP | 3821186 | | 5/2021 | |
| EP | 3841338 | | 6/2021 | |
| EP | 3874211 | | 9/2021 | |
| EP | 3876785 | | 9/2021 | |
| EP | 4079184 | | 10/2022 | |
| ES | 1030365 | | 8/1995 | |
| ES | 1030365 | Y | 7/1996 | |
| GB | 2169024 | A * | 7/1986 | ..... A44B 11/125 |
| GB | 2538290 | A * | 11/2016 | ..... B65D 21/086 |
| JP | 11006677 | | 1/1999 | |
| KR | 1020040080384 | | 9/2004 | |
| KR | 20040109972 | A * | 12/2004 | ..... B65D 43/00 |
| KR | 101004351 | B1 * | 12/2010 | ..... B65D 43/02 |
| KR | 1020210040356 | | 4/2021 | |
| KR | 1020210048496 | | 5/2021 | |
| KR | 1020210084483 | | 7/2021 | |
| MX | PA04001493 | | 12/2004 | |
| MX | PA06014878 | | 10/2007 | |
| WO | 2005123539 | | 12/2005 | |
| WO | 2006007266 | | 1/2006 | |
| WO | 2006009537 | | 1/2006 | |
| WO | 2007016092 | | 2/2007 | |
| WO | 2008013973 | | 1/2008 | |
| WO | WO-2010150985 | A2 * | 12/2010 | ..... B29C 45/0081 |
| WO | 2011094355 | | 8/2011 | |
| WO | 2011100522 | | 8/2011 | |
| WO | 2018095957 | | 5/2018 | |
| WO | 2020013913 | | 1/2020 | |
| WO | 2020041236 | | 2/2020 | |
| WO | 2020091849 | | 5/2020 | |
| WO | 2021050253 | | 3/2021 | |
| WO | 2021050255 | | 3/2021 | |
| WO | 2021050298 | | 3/2021 | |
| WO | 2021086620 | | 5/2021 | |
| WO | 2021145971 | | 7/2021 | |
| WO | 2021154394 | | 8/2021 | |
| WO | 2022081513 | | 4/2022 | |
| WO | 2022232513 | | 11/2022 | |
| WO | 2023275799 | | 1/2023 | |

OTHER PUBLICATIONS

Australian Patent Application No. 2020426341 titled "Cooler latch" filed on Jul. 6, 2022.

European Patent Application No. 20916975.4 titled "Cooler latch" filed on Jul. 12, 2022.

PCT Patent Application No. PCT/US2020/063545 titled "Cooler latch" filed on Dec. 7, 2020.

U.S. Appl. No. 62/967, 199 titled "Cooler Latch", filed Jan. 29, 2020.

Design U.S. Appl. No. 29/708,155, filed Oct. 3, 2019 titled Latch.

Design U.S. Appl. No. 29/708,156, filed Oct. 3, 2019 titled Latch.

Dometic Product Catalog—Coolers; 2015.

Dometic Product Catalog—Coolers; 2016.

Design U.S. Appl. No. 29/820,716, filed Dec. 23, 2021 titled Container.

Design U.S. Appl. No. 29/820,717, filed Dec. 23, 2021 titled Container.

U.S. Appl. No. 17/668,767, filed Feb. 10, 2022 titled Insulated Container.

U.S. Appl. No. 63/353,281, filed Jun. 17, 2022 titled Insulated Container.

PCT Application No. PCT/US2022/031282 filed May 27, 2022 titled Insulated Container.

Design U.S. Appl. No. 29/840,161, filed May 26, 2022 titled Cooler Fender Frame.

U.S. Appl. No. 17/874,162, filed Jul. 26, 2022 titles Thermal Insulation Bag.

U.S. Appl. No. 17/875,693, filed Jul. 28, 2022 titled Containment System Including a Soft Container.

Design U.S. Appl. No. 29/836,642, filed Apr. 28, 2022 titled Half Sleeve Ice Block.

Design U.S. Appl. No. 29/823,704, filed Jan. 19, 2022 titled Insulated Box.

MX Application No. MX/f/2022/002028 filed Jul. 19, 2022 titled Insulated Box.

EU App. No. 009092620 filed Jul. 19, 2022 titled Insulated Box.

U.S. Appl. No. 17/874,701, filed Jul. 27, 2022 titled Locking Module for a Container.

PCT Application No. PCT/US2022/038492 filed Jul. 27, 2022 titled Locking Module for a Container.

U.S. Appl. No. 18/146,053, filed Dec. 23, 2022 titled Cooler.

(56) References Cited

OTHER PUBLICATIONS

Design U.S. Appl. No. 29/882,068, filed Jan. 10, 2023 titled Container.
Design U.S. Appl. No. 29/869,844, filed Jan. 10, 2023 titled Container.
Design U.S. Appl. No. 29/869,843, filed Jan. 10, 2023 titled Container.
Chinese Patent Application No. 202080094463.2 titled "Cooler latch" filed on Jul. 25, 2022.

* cited by examiner

COOLER LATCH

The present application claims priority under 35 U.S.C. § 119 to U.S. Provisional Application No. 62/967,199, entitled "Cooler Latch", filed on Jan. 29, 2020, the entirety of which is incorporated by reference herein.

FIELD OF THE INVENTION

Embodiments described herein relate generally to portable container, particularly for food and/or beverages and which may be a cooler or a warmer, and more particularly to latches used in the opening and closing of portable containers.

DESCRIPTION OF THE ART

Coolers are typically in the form of an insulated container which has walls upstanding from a base to define a top opening to which a removable cover, i.e. a lid, is mounted. Thus, such coolers are typically rectangular with two sidewalls and two end walls, and have a pivotal handle assembly mounted to each end wall, or to each side wall, for carrying the cooler. However, the cooler may be formed into a different geometric or non-geometric shape. As such, conventional coolers have the lid designed to be removable from the body of the container. Generally, the lid may coupled to the body by either i) friction fit, ii) engagement with pivotally mounted locking carrying handles which selective engage and hold the lid on the container, or iii) use of one or more hinges, or latches, at one end of either a side wall or end wall and a locking mechanism or one or more latches at the opposing side of the side wall or end wall that uses the hinges, or latches.

In the embodiments where latches are used in coupling the lid to the body of a cooler, the latches are generally fabricated as a single component made of plastic. Each latch includes a top portion that is coupled to a side portion of the lid, a bottom portion that coupled to a side wall or end wall of the cooler, and an intermediate portion that extends from the top portion of the latch to the bottom portion of the latch. As mentioned above, this intermediate portion also is generally fabricated from plastic since the entire latch is a single component. This intermediate portion is thinner than the top portion and the bottom portion of the latch and is designed to allow the top portion to move between different positions when the lid is moved between an open and closed position with respect to the body of the cooler. The top portion of the latch is retained in a fixed position when the lid is opened and closed since the top portion is attached to the lid of the cooler.

The latch of the prior art used in coolers provide a certain amount of flexes before reaching a point of failure where the intermediate portion of the latch cracks and/or breaks due to stresses and fatigue. The cooler itself is still is good condition for more use; but since the latch breaks before the cooler's end of life, oftentimes, consumers either end up tossing the cooler away and purchase a new one or the consumer must find an appropriate replacement latch and replace the broken latch in order to keep using the cooler. An improved latch that provides more flexes is needed to extend the latch's life to get more use out of the cooler before having to purchase a new cooler or replace the defective latch.

BRIEF DESCRIPTION OF THE DRAWINGS

The foregoing and other features and aspects of the invention are best understood with reference to the following description of certain exemplary embodiments, when read in conjunction with the accompanying drawings, which are not necessarily drawn to scale, and wherein.

Figure 1:
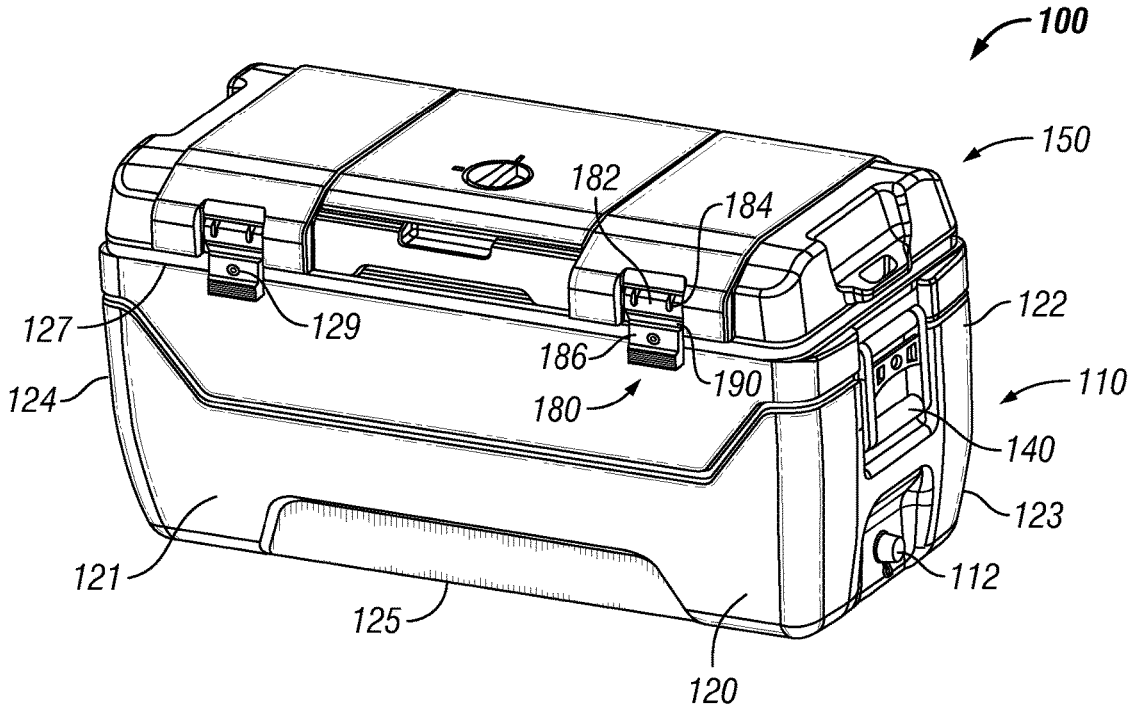
FIG. 1 shows a perspective view of a portable cooler with at least two latches in accordance with an exemplary embodiment.

The drawings illustrate only exemplary embodiments of the invention and are therefore not to be considered limiting of its scope, as the invention may admit to other equally effective embodiments.

DETAILED DESCRIPTION OF EXEMPLARY EMBODIMENTS

The exemplary embodiments discussed herein are directed to various aspects (e.g., methods, systems, devices) of a portable cooler, and more particularly to latches used in the opening and closing of portable containers. In certain exemplary embodiments, the latches used in the opening and closing of portable coolers may be used in one or more of a number of different cooler sizes with various lengths, widths, heights, geometrical and non-geometrical shapes and/or capacities. Further, in certain exemplary embodiments, the portable cooler may be fabricated using different colors, accents, and/or different personalizations, such as by laser etching across one or more of its surfaces. Further, the portable coolers may include other known features including but not limited to wheels, lights, and speakers.

Exemplary embodiments of the portable cooler now will be described more fully hereinafter with reference to the accompanying drawings, in which exemplary embodiments of portable coolers, and more particularly the latches are shown. The portable coolers, and more particularly the latches may, however, be embodied in many different forms and should not be construed as limited to the exemplary embodiments set forth herein. Rather, these exemplary embodiments are provided so that this disclosure will be thorough and complete, and will fully convey the scope of the portable coolers, and more particularly the latches to those or ordinary skill in the art. Like, but not necessarily the same, elements in the various figures are denoted by like reference numerals for consistency.

FIG. 1 shows a perspective view of a portable cooler 100 with at least two latches 180 in accordance with an exemplary embodiment. The portable cooler 100 includes a body 110, a lid 150 that covers an opening (not shown) formed at the upper end of the body 110, and at least one latch 180 that facilitates the lid 150 being removably coupled to a top portion of the body 110. According to some exemplary embodiments, there are at least two latches 180 used to couple the lid 150 to the body 110. There may be at least one hinge, latch or some other coupling mechanism on the opposite side of the two latches 180 that couple the lid 150 to the body 110, whether removable or fixedly, according to certain other exemplary embodiments. The latch 180 is meant to be an assembly that allows for the lid 150 to be removably coupled to the body 110, while a hinge is meant to be an assembly that allows for the lid 150 to pivot or rotate about an axis of the hinge, where the hinge is fixedly coupled to the lid 150 and the body 110.

The body 110 includes an outer shell 120, an inner liner (not shown) disposed within the outer shell 120, an insulation layer (not shown) disposed between the outer shell 120 and the inner liner (not shown), and one or more handles 140 for moving the portable cooler 100. The outer shell 120 is fabricated using blow molding according to some exemplary embodiments, but may be fabricated using other known fabricating techniques. The outer shell 120 may be fabricated as a single piece construction or as multiple, pieces and coupled to one another. The outer shell 120 includes two oppositely positioned longitudinal sides 121, 122 and two oppositely positioned lateral ends 123, 124 that are positioned substantially perpendicular to the ends of the longitudinal sides 121, 122, Alternatively, the sides 121, 122 and the ends 123, 124 of the outer shell 120 may not be perpendicular to one another and can form a different geometric or non-geometric shape without departing from the scope and spirit of the exemplary embodiment. Further, the outer shell 120 may have greater or fewer than four total sides in some exemplary embodiments. The outer shell 120 also includes a bottom 125 that is positioned at the lower ends of each of the longitudinal sides 121, 122 and the lateral ends 123, 124 and collectively forms a cavity (not shown) therein, According to some exemplary embodiments, the outer shell 120 is formed with a recess 127 along the upper edges thereof or adjacently thereto. One or more protrusions 129 are formed within the recess 127 and is used to facilitate the coupling of the latch 180 to the body 110. In other exemplary embodiments, the protrusions 129 are formed along the upper portion of the outer shell 120 even though a recess 127 is not formed. The protrusions 129 are cylindrical in shape by can be formed in other geometric or non-geometric shapes. The outer shell 120 is dimensioned and sized such that the inner liner (not shown) is inserted into the cavity (not shown) and a space (not shown) is created between the outer surface of the inner liner (not shown) and the inner surface of the outer shell 120. The space (not shown) is filled with the insulation layer (not shown), which may be air, Styrofoam® (closed-cell extruded polystyrene foam), or some other known, either now or in the future, insulating material. Although FIG. 1 shows an exemplary embodiment of the outer shell 120, the outer shell 120 may be different than that shown. For example, according to some exemplary embodiments, the outer shell 120 may be fabricated to accommodate other known features, such as wheels, a sliding handle, or compartments for storing items like a cell phone or umbrella.

The liner (not shown) is fabricated using injection molding according to some exemplary embodiment, but may be fabricated using other known fabricating techniques. The liner is fabricated similarly to the outer shell 120 and is designed to be inserted into the outer shell 120. According to some exemplary embodiments, the inner liner may be a different geometric or non-geometric shape than the outer shell 120 without departing from the scope and spirit of the exemplary embodiment. Once the inner liner is disposed within the outer shell 120, the space, as mentioned above is formed therebetween.

The insulation layer (not shown) is disposed within the space formed between the outer surface of the inner liner and the inner surface of the outer shell 120. The insulation layer is fabricated either prior to the liner being placed within the outer shell 120 or is formed while the liner is already positioned within the outer shell 120. In the embodiment where the insulation layer is formed prior to the liner being placed within the outer shell 120, the insulation layer is formed using expanded polystyrene foam. Once the insulation layer is formed, the insulation layer is positioned within the outer shell 120 and is friction fitted or snapped therein. Once the insulation layer is secured to the outer shell 120, the liner is then positioned within the insulation layer and secured to the outer shell 120 along the upper edges using a lip formed along the upper edges of the inner liner or secured to the insulation layer.

Alternatively, in the embodiment where the insulation layer is formed while the liner is already disposed within the outer shell 120 and the space is formed between the outer surface of the liner and the inner surface of the outer shell 120, the insulation layer is formed by injecting a polyurethane foam into the space formed between the inner liner and the outer shell 120, thereby allowing the foam to expand and fill in the space formed between the liner and the outer shell 120. Once the polyurethane foam dries, the insulation layer is formed and is adhered to both the outer surface of the liner and the inner surface of the outer shell 120. Although certain materials have been described in forming the two embodiments of the insulation layer, other known materials may be used that provides insulation capabilities.

The body 110 also includes one or more handles 140. According to some exemplary embodiments, the one or more handles 140 may be formed into the outer surface of the outer shell 120, as is known in the prior art. For example, one handle 140 may be formed along at least one end or side of the outer shell, while wheels are positioned at the lower opposite end or side to assist a user in carrying the portable cooler 100 at one end and rolling it along. In another example, one handle 140 may be formed along at least one end or side of the outer shell, while another handle 140 is formed along at least one opposite end or side of the outer shell allowing one or more users to carry the portable cooler 100 using the handles 140 from one location to another. According to other exemplary embodiments, the handles 140 are handle assemblies that are coupled to at least one end or side of the outer shell in lieu of the formed handles as mentioned above.

Although certain features of the body 110 have been described above, the body 110 may have additional features that have not been described, such as a drain port 112 formed at the lower portion of the body 110. The lack of description for any additional features of the body 110 is not meant to limit the scope and spirit of the present embodiments as described herein.

Figure 2A:
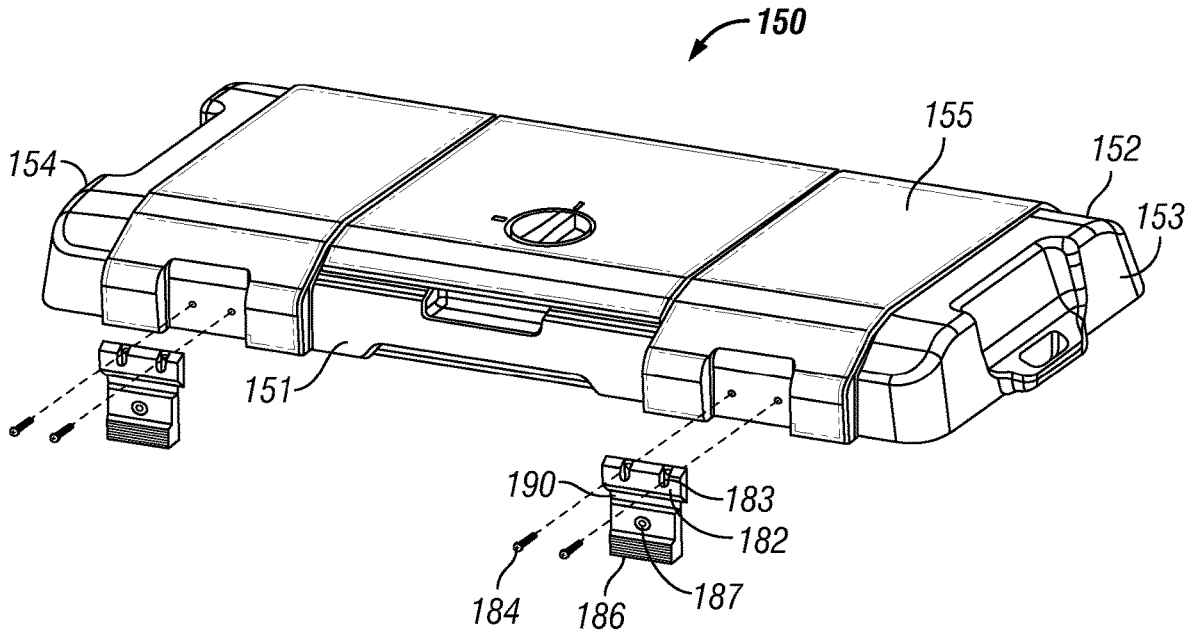
FIG. 2A shows an assembly view of the lid and the two latches of FIG. 1 in accordance with an exemplary embodiment.
Figure 2B:
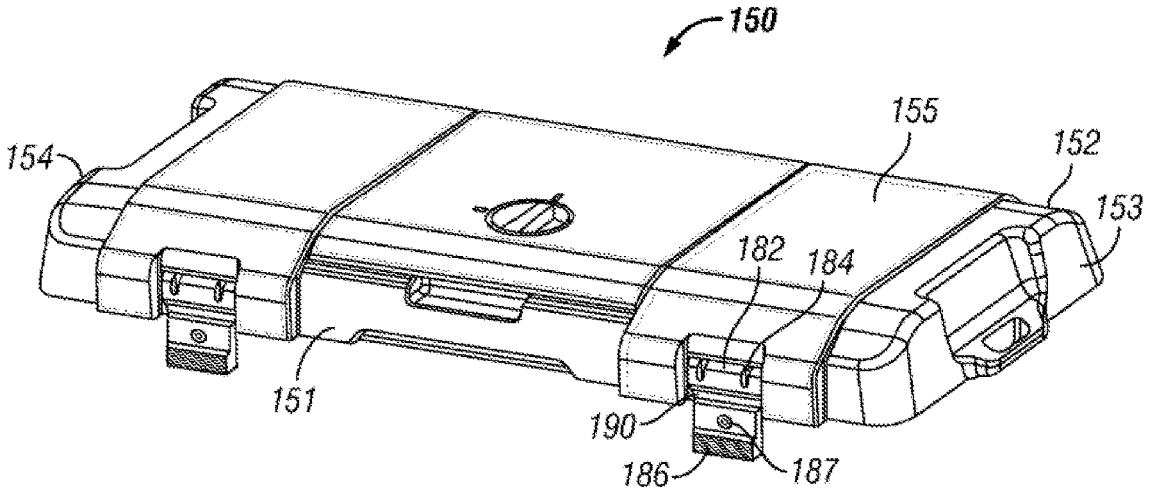
FIG. 2B shows a perspective view of the two latches coupled to the lid of FIG. 2A in accordance with an exemplary embodiment.

FIG. 2A shows an assembly view of the lid 150 and the two latches 180 of FIG. 1 in accordance with an exemplary embodiment. FIG. 2B shows a perspective view of the two latches 180 coupled to the lid 150 of FIG. 2A in accordance with an exemplary embodiment. Referring to FIGS. 1-2B, the lid 150 is fabricated using blow molding according to some exemplary embodiments, but may be fabricated using other known fabricating techniques. The lid 150 may be fabricated as a single piece construction or as multiple pieces and coupled to one another to form the lid 150. The lid 150 includes two oppositely positioned longitudinal sides 151, 152 and two oppositely positioned lateral ends 153, 154 that are positioned substantially perpendicular to the ends of the longitudinal sides 151, 152. Alternatively, the longitudinal sides 151, 152 and the lateral ends 153, 154 of the lid 150 may not be perpendicular to one another and can form a different geometric or non-geometric shape without departing from the scope and spirit of the exemplary embodiment. Further, the lid 150 may have greater or fewer than four total sides in some exemplary embodiments. The lid 150 also includes a top 155 that is positioned at the upper ends of each of the longitudinal sides 151, 152 and the lateral ends 153, 154 and may form a cavity (not shown) therein. The lid 150 is dimensioned and sized such that the lid 150 is able to be coupled with the body 110. According to the embodiment as shown, the longitudinal side 152 of the lid 150 is coupled to the longitudinal side 122 of the outer shell 120 using one or more hinges (not shown); however, the lid 150 may be coupled along those longitudinal sides 152, 122 using one or more latches 180. Also according to the embodiment as shown, the longitudinal side 151 of the lid 150 is coupled to the longitudinal side 121 of the outer shell 120 using two latches 180; however, the lid 150 may be coupled along those longitudinal sides 151, 121 using greater or fewer latches 180. Although FIGS. 1-2B shows an exemplary embodiment of the lid 150, the lid 150 may be different than that shown.

Although certain features of the lid 150 have been described above, the lid 150 may have additional features that have not been described, such as a ruler 156 or cup holders (not shown) that is formed along the top 155 of the lid 150. The lack of description for any additional features of the lid 150 is not meant to limit the scope and spirit of the present embodiments as described herein.

The latch 180 is fabricated using at least a thermoplastic rubber material, or TPR material. In certain exemplary embodiment, the thermoplastic rubber material includes certain ultraviolet and/or chemical resistant additives to prevent dry rotting, whereby these additives are known in the prior art. The latch 180 is fabricated in three components according to the embodiment described herein, but the latch 180 may be fabricated in grater or fewer components according to other exemplary embodiments. According to the exemplary embodiment, the latch 180 includes an upper component 182, a lower component 186, and an intermediate component 190 that couples the upper component 182 to the lower component 186.

The upper component 182 and lower component 186 are molded components but can be fabricated in other manners. The upper component 182 and lower component 186 are fabricated using polypropylene, but may be fabricated using other materials, preferably of a durable material and which can be coupled to the intermediate component 190, such as a blended or some other material. The upper component 182 is a thin rectangular shape and is smaller in size than the lower component 186, which is a wider rectangular or square-shaped component. However, in other exemplary embodiments, the upper component 182 and lower component 186 may be a different shape and size and may also be sized where the upper component 182 is larger in size than the lower component 186. The upper component 182 has two apertures 183 formed therein separated a distance apart from one another, where the apertures 183 are dimensioned to receive a screw 184 or other fastener for fixedly coupling the upper component 182 to the lid's 150 longitudinal side 151. According to other exemplary embodiments, the number of apertures 183 may be greater or fewer than two. The lower component 186 has an opening 187 formed therein that is dimensioned to receive the respective protrusion 129 for removably coupling the lower component 186 to the body's 110 longitudinal side 121. Hence, a user can release the lower component 186 from the protrusion 129, thereby opening the lid 150 from the body 110. According to other exemplary embodiments, the number of openings 187 may be greater than one, but generally corresponds to the number of protrusions 129 used for coupling the lower component 186 to the body's 110 longitudinal side 121. In certain other exemplary embodiments, the upper component 182 may be coupled to the lid's 150 longitudinal side 151 using an opening and complementary protrusion that may be formed into the lid 150, similar to how the lower component 186 is coupled to the body 110 without departing from the scope and spirit of the exemplary embodiments.

The intermediate component 190 is fabricated using a thermoplastic rubber material, which is durable and is flexible. Although the intermediate component 190 is fabricated using thermoplastic rubber material, other materials including, but not limited to, thermoplastic elastomer (TPE), silicone, or other similar flexible materials, may be used. This intermediate portion 190 is more easily seen with respect to FIGS. 3A and 3B, which is described in more detail below. The intermediate component 190 is formed as a single component and includes a first portion 392, a second portion 396, and a middle portion 394, which collectively forms a substantially V-shaped component with a flat apex rather than a pointed apex. The intermediate portion 190 is of a uniform thickness according to some exemplary embodiments, but in other exemplary embodiments, the first portion 392 and the second portion 396 have a greater thickness than the middle portion 394 or at least one of the first portion 392 and the second portion 396 have a greater thickness than the middle portion 394, or the middle portion 394 has a greater thickness than at least one of the first portion 392 and the second portion 396, depending upon the angles desired before the latch 180 reaches its auto-stop angle or rotational distance. A side of the intermediate component's 190 first portion 392 is coupled to a side of the upper component 182, while a side of the intermediate component's 190 second portion 396 is coupled to a side of the lower component 186. This coupling is performed using a chemical and mechanical bond; however, the coupling may be accomplished using other known coupling methods without departing from the scope and spirit of the exemplary embodiment. According to embodiments where the entire latch 180 is fabricated using a single material, each of the upper component 182, the lower component 186, and the intermediate component 190 is fabricated using the thermoplastic rubber; thereby allowing the entire latch 180 be fabricated as a single component or remain fabricated in multiple components.

Figure 3A:
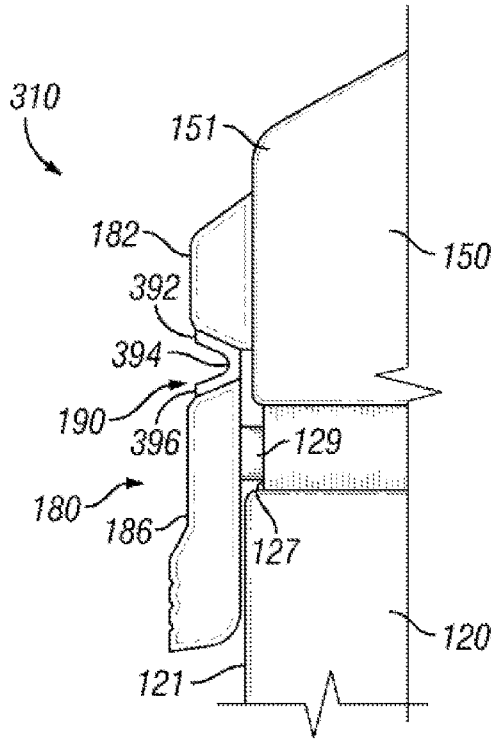
FIG. 3A shows a partial side view of the portable cooler of FIG. 1 illustrating the latch in a lock position in accordance with an exemplary embodiment.
Figure 3B:
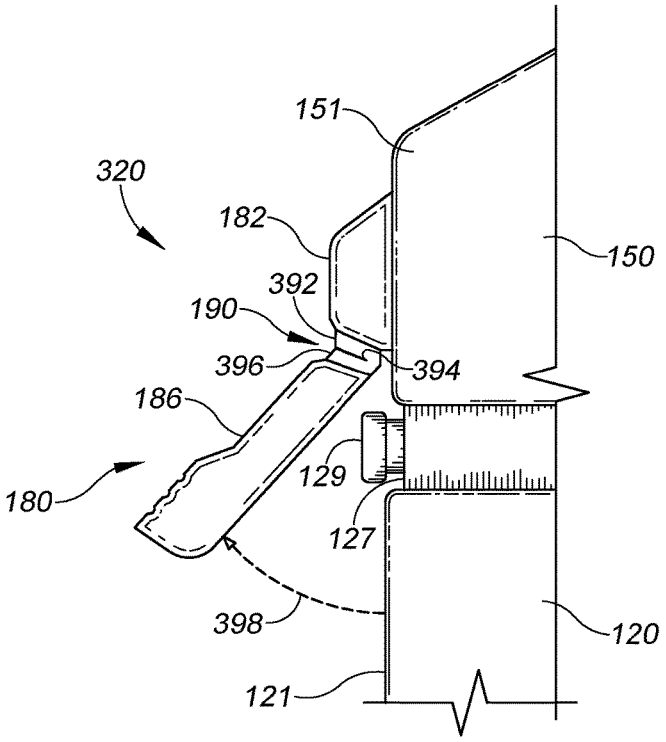
FIG. 3B shows a partial side view of the portable cooler of FIG. 1 illustrating the latch in a maximum open position in accordance with an exemplary embodiment.

FIG. 3A shows a partial side view of the portable cooler 100 of FIG. 1 illustrating the latch 180 in a lock position 310 in accordance with an exemplary embodiment. FIG. 3B shows a partial side view of the portable cooler 100 of FIG. 1 illustrating the latch 180 in a maximum open position 320 in accordance with an exemplary embodiment. When in the lock position 310, the upper component 182 is fixedly coupled to the lid's 150 longitudinal side 151 using screws 184 (FIG. 2A). The intermediate component 190 is coupled to the upper component 182 via an adhesive or some other known method at the intermediate component's 190 first portion 392. The intermediate component 190 also is coupled to the lower component 186 via an adhesive or some other known method at the intermediate component's 190 second portion 396. The intermediate component 190 is in a relaxed state. The lower component 186 is removably coupled to the outer shell's 120 longitudinal side 121 having the protrusion 129 that extends outwardly from the outer shell's 120 recess 127 inserted into and snapped into the opening 187 formed in the lower portion 186. When in the lock position 310, the intermediate component's 190 middle portion 394 is flat and in a relaxed state.

To unlock the latch 180, a user pulls the lower component 186 such that the lower component pulls away from the protrusion 129 in a direction away from the outer shell 120. The lower component 186 can continue to move away from the outer shell 120 as the intermediate component 190 goes into a more stressed state. The lower component 186 can continue to move away from the outer shell 120 until a portion of the intermediate component's 190 second portion 396 comes into contact with a portion of the intermediate component's 190 first portion 392. Once the intermediate component's 190 second portion 396 comes into contact with a portion of the intermediate component's 190 first portion 392, the latch is in a maximum open position 320. This intermediate component's 190 second portion 396 coming into contact with the intermediate component's 190 first portion 392 is a built-in auto stop feature of the latch 180 that prevents over stretching of the intermediate component 190, or in more particular, prevents the over stretching of the intermediate component's 190 middle portion 394. When in the maximum open position 320, the intermediate component's 190 middle portion 394 is curved and in a maximum stressed state. By having the auto stop feature and preventing over stretching of the intermediate component 190, the latch 180 will have many more times that the latch 180 can be open and closed without the middle portion 394 of the intermediate portion 190 breaking.

The auto stop feature of the latch 180 can be designed by manipulating the thickness of either or both of the first portion 392 and the second portion 396 of the intermediate component 190. The maximum angle 398 occurs when the latch 180 is in the maximum open position 320. This maximum angle 398 is designed to be about fifty degrees. In other exemplary embodiments, the maximum angle 398 is designed to be in a range from about thirty degrees to about sixty degrees. In yet other exemplary embodiments, the maximum angle 398 is designed to be in a range from about twenty-five degrees to about sixty-five degrees. In further exemplary embodiments, the maximum angle 398 is designed to be in a range from about fifteen degrees to about eighty degrees. Although this angle has been provided in several different ranges, the auto stop maximum angle can at any angle greater than five degrees without departing from the scope and spirit of the exemplary embodiments. Further, in some exemplary embodiments, the upper component 182, the lower component 186, and the intermediate component 190 can be provided in a vast variety of colors, where all of the upper component 182, the lower component 186, and the intermediate component 190 are the same color or where at least one of the upper component 182, the lower component 186, and the intermediate component 190 is a different color from at least one of the others 182, 186, 190, Accordingly, many modifications and other embodiments set forth herein will come to mind to one skilled in the art to which insulated coolers pertain, and more specifically to the latches of the coolers, having the benefit of the teachings presented in the foregoing descriptions and the associated drawings. Therefore, it is to be understood that these insulated coolers are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A latch assembly, comprising:

an upper component having at least one fastener aperture formed therein, said at least one fastener aperture passing through a forward facing surface of said upper component, said at least one fastener aperture configured to receive a fastener;

a lower component having at least one opening formed in a forward facing surface or a rearward facing surface thereof, said upper component and said lower component formed of at least one first material; and an intermediate component having a first portion and a second portion, the first portion being coupled to the upper component and the second portion being coupled to the lower component, wherein the intermediate component is fabricated using a flexible material that differs from said at least one first material, and wherein said second portion is configured to flex to a position in which said second portion engages said first portion to form an auto stop feature.

2. The latch assembly of claim 1, wherein the intermediate component is fabricated using a thermoplastic rubber material.

3. The latch assembly of claim 1, wherein the upper component is fabricated using polypropylene.

4. The latch assembly of claim 1, wherein the lower component is fabricated using polypropylene.

5. The latch assembly of claim 1, wherein the intermediate component further comprises a middle portion that couples the first portion to the second portion, wherein the first portion, the middle portion, and the second portion collectively form a v-shape having a flat apex portion.

6. The latch assembly of claim 5, wherein the lower component is rotatably movable with respect to the upper component about the middle portion as the intermediate component moves from a relaxed state to a stressed state.

7. The latch assembly of claim 1, wherein the lower component is capable of moving towards the upper component and stops at a maximum open position when the second portion of the intermediate component meets the first portion of the intermediate component creating said auto stop feature.

8. The latch assembly of claim 7, wherein the lower component is capable of moving from a relaxed state to the maximum open position, wherein an angle the lower component moves from the relaxed state to the maximum open position is fifty degrees.

9. The latch assembly of claim 7, wherein the lower component is capable of moving from a relaxed state to the maximum open position, wherein an angle the lower component moves from the relaxed state to the maximum open position ranges from twenty-five degrees to sixty-five degrees.

10. An insulated cooler comprising:

a body comprising an outer shell, an inner liner disposed therein creating a gap therebetween, and configured to receive an insulating layer within the gap;

the body defining a cavity therein with an opening formed at its upper distal end;

a lid movably coupled to the body and covering the opening of the body; and, at least one latch assembly, comprising:

an upper component having at least one aperture formed in a forward facing surface configured to receive a fastener;

a lower component having at least one opening formed therein; and an intermediate component having a first portion, a middle portion, and a second portion, the first portion being coupled to the upper component and the second portion being coupled to the lower component, wherein said middle portion creates a space between said first portion and said second portion allowing flexible movement of said second portion toward a position in which said second portion engages said first portion to define an auto stop feature, and wherein the intermediate component is fabricated using a flexible material, wherein the upper component is coupled to the lid using the at least one aperture, and wherein the lower component is coupled to a top portion of the outer shell using the at least one opening.

11. The insulated cooler of claim 10, wherein the intermediate component is fabricated using a thermoplastic rubber material.

12. The insulated cooler of claim 10, wherein at least one of the upper component and the lower component is removably coupled to the lid and the outer shell, respectively.

13. The insulated cooler of claim 10, wherein at least one of the upper component and the lower component is fixedly coupled to the lid and the outer shell, respectively.

14. The insulated cooler of claim 10, wherein the upper component is fabricated using polypropylene.

15. The insulated cooler of claim 10, wherein the lower component is fabricated using polypropylene.

16. The insulated cooler of claim 10, wherein the middle portion of the intermediate component couples the first portion to the second portion, wherein the first portion, the middle portion, and the second portion collectively form a v-shape having a flat apex portion.

17. The insulated cooler of claim 16, wherein the lower component is rotatably movable with respect to the upper component about the middle portion as the intermediate component moves from a relaxed state to a stressed state.

18. The insulated cooler of claim 10, wherein the lower component is capable of moving towards the upper component and stops at a maximum open position when the second portion of the intermediate component meets the first portion of the intermediate component creating the auto stop feature.

19. The insulated cooler of claim 18, wherein the lower component is capable of moving from a relaxed state to the maximum open position, wherein an angle the lower component moves from the relaxed state to the maximum open position is fifty degrees.

20. The insulated cooler of claim 18, wherein the lower component is capable of moving from a relaxed state to the maximum open position, wherein an angle the lower component moves from the relaxed state to the maximum open position ranges from twenty-five degrees to sixty-five degrees.

* * * * *